US009265990B2

(12) United States Patent
Reese et al.

(10) Patent No.: US 9,265,990 B2
(45) Date of Patent: Feb. 23, 2016

(54) AQUATIC EXERCISE SYSTEM

(71) Applicants: Kevin A. Reese, Palm Harbor, FL (US); Randolph H. Reese, Palm Harbor, FL (US)

(72) Inventors: Kevin A. Reese, Palm Harbor, FL (US); Randolph H. Reese, Palm Harbor, FL (US)

( * ) Notice: Subject to any disclaimer, the term of this patent is extended or adjusted under 35 U.S.C. 154(b) by 0 days.

(21) Appl. No.: 14/335,001

(22) Filed: Jul. 18, 2014

(65) Prior Publication Data

US 2016/0016046 A1 Jan. 21, 2016

(51) Int. Cl.
*A63B 31/00* (2006.01)
*A63B 21/06* (2006.01)

(52) U.S. Cl.
CPC ..... *A63B 31/00* (2013.01); *A63B 2225/60* (2013.01); *A63B 2244/20* (2013.01)

(58) Field of Classification Search
CPC ..... A63B 31/00; A63B 2225/60; A63B 2225/105; A63B 2225/107; A63B 2225/10; A63B 21/154; A63B 21/285; A63B 21/28; A63B 21/06; A63B 21/0601; A63B 21/0602; A63B 21/0611; A63B 21/062; A63B 21/15; A63B 21/152; A63B 21/156; A63B 21/153; A63B 2208/03; A63B 2244/20; A63B 2021/0614; A63B 69/12; A63B 69/125; A63B 69/14; A63B 35/00
USPC ..... 482/55, 102, 103
See application file for complete search history.

(56) References Cited

U.S. PATENT DOCUMENTS

| | | | | | |
|---|---|---|---|---|---|
| 499,205 | A * | 6/1893 | Bryon, Jr. | ..... | 482/102 |
| 3,861,675 | A * | 1/1975 | Hopper | ..... | 482/55 |
| 4,084,815 | A * | 4/1978 | Flannery | ..... | 482/94 |
| 4,527,795 | A * | 7/1985 | Zink | ..... | 482/55 |
| 4,577,859 | A * | 3/1986 | Gossett | ..... | 482/55 |
| 4,838,545 | A * | 6/1989 | Wilson | ..... | 482/97 |
| 5,072,934 | A * | 12/1991 | Blanes | ..... | 482/94 |
| 2011/0237405 | A1* | 9/2011 | Reyes | ..... | 482/94 |
| 2015/0080194 | A1* | 3/2015 | Lin | ..... | 482/86 |

* cited by examiner

*Primary Examiner* — Oren Ginsberg
*Assistant Examiner* — Nyca T Nguyen

(57) ABSTRACT

A housing assembly includes a plurality of hollow pipes forming a base section horizontally disposed and a support section vertically disposed with a top pipe. An operational assembly includes a plurality of block and tackle subassemblies. Each block and tackle sub assembly includes a fixed block with a plurality of upper pulleys depending from the top pipe. Each block and tackle sub assembly includes a movable tackle with a plurality of lower pulleys. Each movable tackle includes a cord with a fixed end, a movable end, and an intermediate section. The intermediate section winds back and forth between the lower pulleys and the upper pulleys. A belt has a clip attached to the movable end of each cord.

1 Claim, 3 Drawing Sheets

FIG. 7
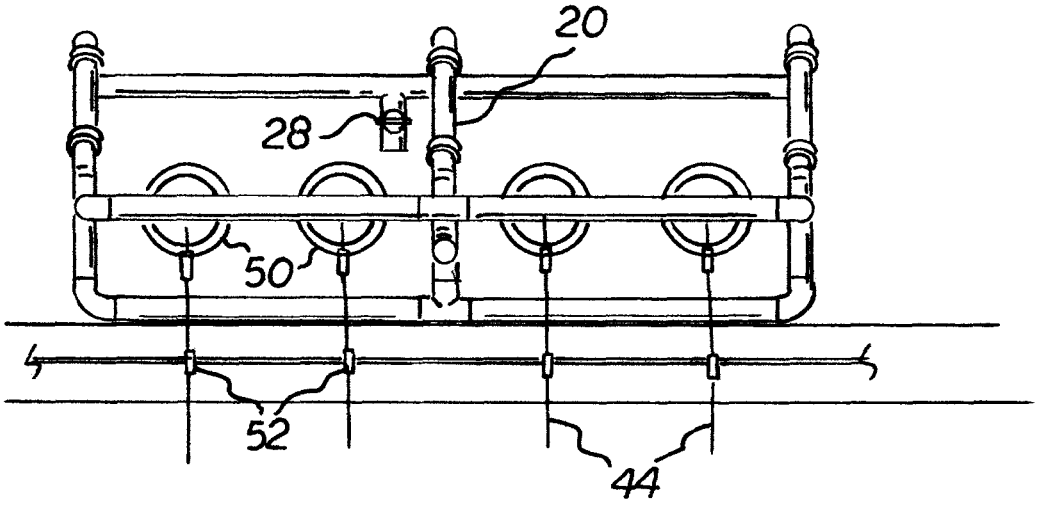
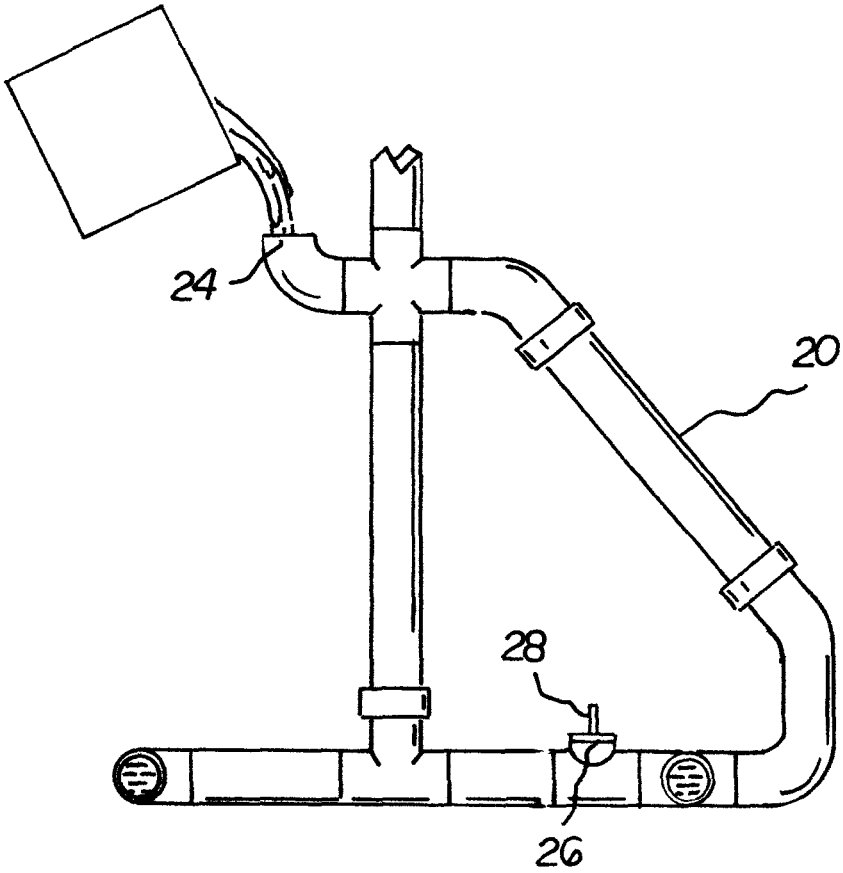
FIG. 8

AQUATIC EXERCISE SYSTEM

BACKGROUND OF THE INVENTION

Field of the Invention

The present invention relates to an aquatic exercise system and more particularly pertains to applying a resistive force to an exercising swimmer, for extending such resistive force to a number of swimmers, and for varying the number of swimmers to experience such resistive force, the applying and the extending and the varying being done in a safe, convenient, and economic manner.

SUMMARY OF THE INVENTION

In view of the foregoing disadvantages inherent in the known types of exercise systems of known designs and configurations now present in the prior art, the present invention provides an improved aquatic exercise system. As such, the general purpose of the present invention, which will be described subsequently in greater detail, is to provide a new and improved aquatic exercise system and method which has all the advantages of the prior art and none of the disadvantages.

To attain this, from a broadest standpoint, the present invention essentially comprises a housing assembly. The housing assembly includes a plurality of hollow pipes forming a base section horizontally disposed and a support section vertically disposed with a top pipe. An operational assembly includes a plurality of block and tackle subassemblies. Each block and tackle sub assembly includes a fixed block with a plurality of upper pulleys depending from the top pipe. Each block and tackle sub assembly includes a movable tackle with a plurality of lower pulleys. Each movable tackle includes a cord with a fixed end, a movable end, and an intermediate section. The intermediate section winds back and forth between the lower pulleys and the upper pulleys. A belt has a clip attached to the movable end of each cord.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved aquatic exercise system which has all of the advantages of the prior art exercise systems of known designs and configurations and none of the disadvantages.

It is another object of the present invention to provide a new and improved aquatic exercise system which may be easily and efficiently manufactured and marketed.

It is a further object of the present invention to provide a new and improved aquatic exercise system which is of durable and reliable constructions.

An even further object of the present invention is to provide a new and improved aquatic exercise system which is susceptible of a low cost of manufacture with regard to both materials and labor, and which accordingly is then susceptible of low prices of sale to the consuming public, thereby making such aquatic exercise system economically available to the buying public.

Lastly, another object of the present invention is to provide an aquatic exercise system for applying a resistive force to an exercising swimmer, for extending such resistive force to a number of swimmers, and for varying the number of swimmers to experience such resistive force, the applying and the extending and the varying being done in a safe, convenient, and economic manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a plan view of a portion of the system taken along line 7-7 of FIG. 3.

FIG. 8 is a cross sectional view of a portion of the system taken along line 8-8 of FIG. 3 illustrating the filling of the housing assembly with water for weighting purposes.

The same reference numerals refer to the same parts throughout the various Figures.

DESCRIPTION OF THE PREFERRED EMBODIMENT

Figures 1, 2:
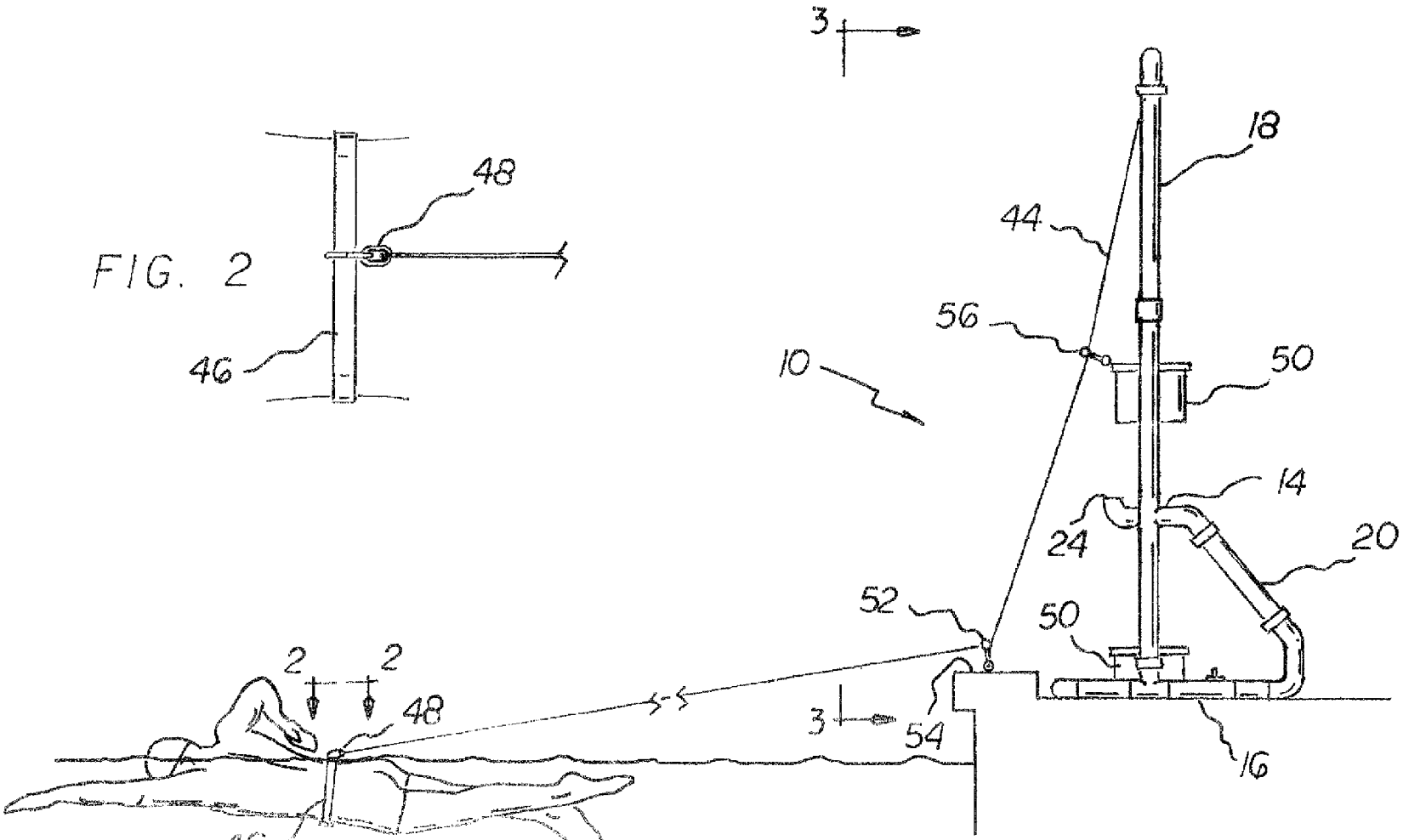
FIG. 1 is a side elevational view of an aquatic exercise system constructed in accordance with the principles of the present invention.
FIG. 2 is a plan view of a portion of the system taken along line 2-2 of FIG. 1.
Figure 3:
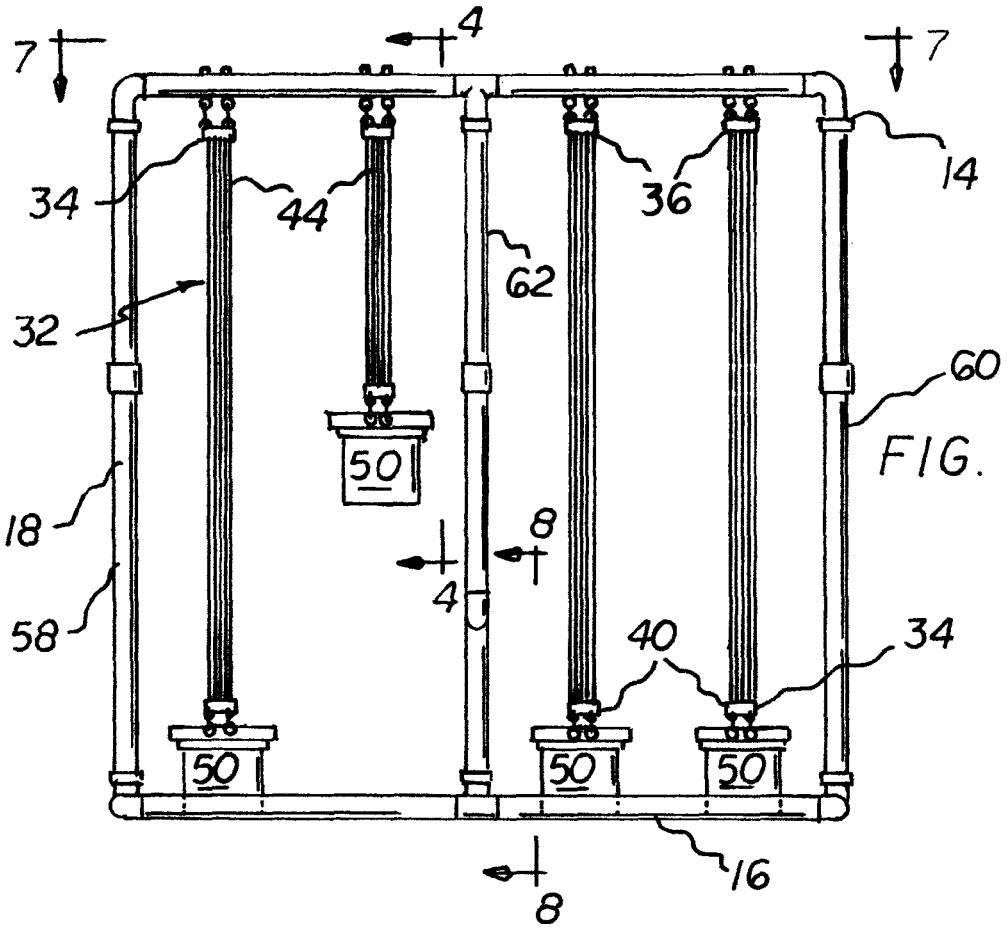
FIG. 3 is a front elevational view of a portion of the system taken along line 3-3 of FIG. 1.
Figure 4:
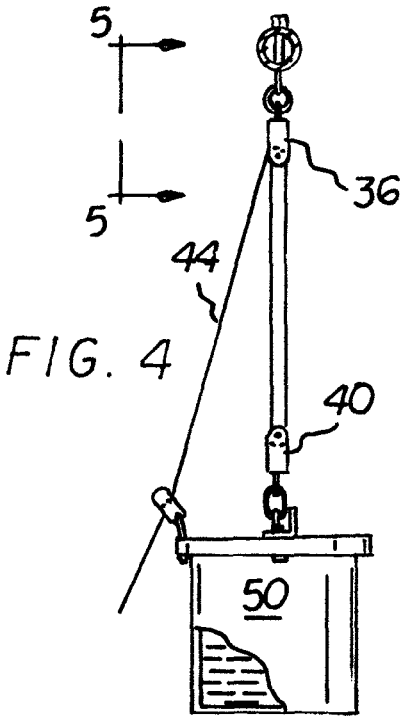
FIG. 4 is a cross sectional view of a portion of the system taken along line 4-4 of FIG. 3.

With reference now to the drawings, and in particular to FIG. 1 thereof, the preferred embodiment of the new and improved aquatic exercise system embodying the principles and concepts of the present invention and generally designated by the reference numeral 10 will be described.

The present invention, the aquatic exercise system 10 is comprised of a plurality of components. Such components in their broadest context include a housing assembly, an operational assembly, and a belt. Such components are individually configured and correlated with respect to each other so as to attain the desired objective.

From a specific standpoint, first provided is a housing assembly 14. The housing assembly includes a plurality of hollow pipes. The hollow pipes are fabricated of polyvinyl chloride. The housing assembly includes a base section 16. The base section is horizontally disposed. The base section is in a rectangular configuration. The housing assembly includes a support section 18. The support section is vertically disposed. The support section is also in a rectangular configuration. The support section has a top pipe. The housing assembly also includes an intermediate section 20. The intermediate section is angularly disposed. The intermediate section couples the base section. The intermediate section further couples the intermediate region of the support section. The housing assembly includes a water inlet port 24. The water inlet is provided adjacent to the intermediate region of the housing assembly. In this manner water is provided below the inlet port as a weight. Further in this manner the housing assembly is stabilized the housing. The housing assembly also includes a water outlet port 26. The water outlet portion has a removable cover 28. In this manner emptying the water from the housing assembly when not in use is facilitated.

An operational assembly 32 is provided. The operational assembly includes four block and tackle subassemblies 34. Each block and tackle sub assembly includes a fixed block 36. Each fixed block has a plurality of upper pulleys 38. The upper pulleys depend from the top rail. The upper pulleys are rotatable around a common upper axis. Each block and tackle sub assembly includes a movable tackle 40. Each movable tackle has a plurality of lower pulleys. The lower pulleys are rotatable around a common lower axis. Each block and tackle subassembly includes a cord 44. The cord has a fixed end. The cord also has a movable end. The cord further has an intermediate section. The fixed end is attached to an associated block. The intermediate section winds back and forth between the lower pulleys and the upper pulleys. In this manner pulling the movable end of any cord will raise its associated tackle.

Provided last is a belt 46. The belt has a clip 48. The clip is attached to the movable end of each cord. The belt is positionable around a waist of a swimmer during use while swimming for exercise. A water bucket 50 is provided. The water bucket is attached to each tackle. The water bucket depends from each tackle. In this manner an increased resistive force is provided to the swimmer during use. A pool 54 is provided. A fixed eyelet 52 is provided. The fixed eyelet is attached to the pool 54 during use with the cord passing through the fixed eyelet for guiding purposes. A movable eyelet 56 is provided. The movable eyelet is attached to the bucket during use with the cord passing through the movable eyelet for guiding purposes.

The housing assembly has two vertical end pipes 58, 60 and a vertical center pipe 62. The vertical center pipe is equally spaced between the two vertical end pipes. Two operational subassemblies/block and tackle subassemblies are located on each side of the vertical center pipe. The pipes on one side of the vertical central pipe are adapted to be removed along with the respective two operational subassemblies/block and tackle subassemblies. In this manner the system is rendered for use by two swimmers rather than for use by more swimmers. The pipes on one side of the vertical central pipe are adapted to be separated. A supplemental vertical central pipe may be added with associated horizontal pipes and supplemental operational subassemblies. In this manner the system is rendered for use by six swimmers rather than for use by fewer swimmers.

Figure 5:
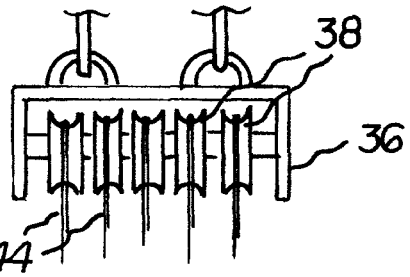
FIG. 5 is a front elevational view of a portion of the system taken along line 5-5 of FIG. 4.

An alternate embodiment of the invention is shown in FIG. 5. In this embodiment, five upper pulleys 38 are provided and five lower pulleys are provided. The cord 44 provided is of a length to accommodate a swimmer exercising by swimming 25 meters.

Figure 6:
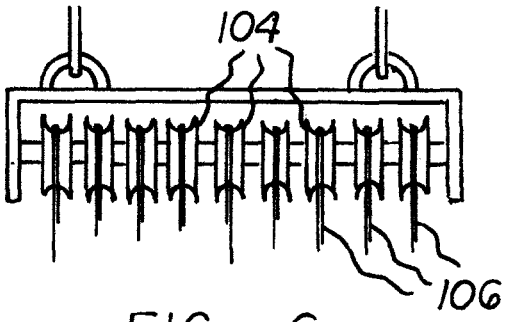
FIG. 6 is a front elevational view similar to FIG. 5 but illustrating an alternate embodiment of the invention.

In an alternate embodiment 100 of the present invention, nine upper pulleys 104 are provided and nine lower pulleys are provided. A cord 106 is also provided. The cord is of a length to accommodate a swimmer exercising by swimming 50 meters. Note FIG. 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An aquatic exercise system for applying a resistive force to an exercising swimmer, for extending such resistive force to a number of swimmers, and for varying the number of swimmers to experience such resistive force, the applying and the extending and the varying being done in a safe, convenient, and economic manner, the system comprising, in combination:

a housing assembly formed of a plurality of hollow pipes, the hollow pipes being fabricated of polyvinyl chloride, the housing assembly including a base section horizontally disposed in a rectangular configuration, the housing assembly including a support section vertically disposed in a rectangular configuration with a top pipe, the housing assembly including an intermediate section angularly disposed and coupling the base section and an intermediate region of the support section, a water inlet port adjacent to the intermediate section of the housing assembly to provide water below the inlet port as a weight to stabilize the housing assembly, a water outlet port with a removable cover to facilitate emptying the water from the housing assembly when not in use;

an operational assembly formed of four block and tackle subassemblies, each block and tackle subassembly including a fixed block with a plurality of upper pulleys coupled to the top pipe and rotatable around a common upper axis, each block and tackle subassembly including a movable tackle with a plurality of lower pulleys rotatable around a common lower axis, each block and tackle subassembly including a cord with a fixed end and a movable end and an intermediate section, the fixed end attached to an associated block, the intermediate section of the cord winding back and forth between the lower pulleys and the upper pulleys whereby pulling the movable end of any cord will raise its associated tackle; and a belt with a clip attached to the movable end of each cord, the belt configured to be positionable around a waist of the exercising swimmer during use while swimming for exercise, a water bucket attached to and coupled to each block and tackle subassembly for providing an increased resistive force to the exercising swimmer during use, a fixed eyelet attached to a pool during use with the cord passing through the fixed eyelet for guiding purposes, a movable eyelet attached to each water bucket during use with the cord passing through the movable eyelet for guiding purposes;

the plurality of hollow pipes including two vertical end pipes, and a vertical center pipe, equally spaced between the two vertical end pipes, two block and tackle subassemblies of the four block and tackle subassemblies being located on each side of the vertical center pipe, the plurality of hollow pipes on one side of the vertical central pipe adapted to be removed along with the respective two block and tackle subassemblies to render the system for use by two swimmers rather than for use by more swimmers.

* * * * *